US005374362A

United States Patent [19]

McFarland

[11] Patent Number: 5,374,362

[45] Date of Patent: Dec. 20, 1994

[54] UV LIGHT PROTECTION FORMULA FOR FABRIC, LEATHER, VINYL AND WOOD SURFACES

[76] Inventor: Steven M. McFarland, 1204 Sassone Ct., Milpitas, Calif. 95035

[21] Appl. No.: 978,276

[22] Filed: Nov. 18, 1992

[51] Int. Cl.[5] ..... B05D 7/12; B05D 7/06

[52] U.S. Cl. ..... 252/8.6; 8/442; 8/443; 8/444; 427/150; 427/151; 427/152; 428/211; 428/212; 428/213; 428/423.1; 428/425.9

[58] Field of Search ..... 8/442, 443, 444; 427/150, 151, 152, 389; 428/211, 212, 213, 412, 423.1, 425.9; 252/8.6

[56] References Cited

U.S. PATENT DOCUMENTS 4,339,503 7/1982 Rukavina et al. ..... 428/412

4,886,774 12/1989 Doi ..... 503/226

4,981,773 1/1991 Suzuki ..... 8/442

5,143,729 9/1992 Thompson ..... 424/402

*Primary Examiner*—Paul Lieberman

*Assistant Examiner*—Michael P. Tierney

*Attorney, Agent, or Firm*—Richard L. Miller

[57] ABSTRACT

Provided is a plurality of ultra-violet light protection formulas in the form of liquids and creams which can be topically applied to various surfaces/substrates to protect such surfaces from the deleterious effects of light primarily in the ultra violet range and in addition, enhance the surface characteristics in some instances. The surfaces/substrates can by typically leather, vinyl, finished wood, unfinished wood, and a host of others too numerous to mention. An example of one formula is illustrated with an ultra-violet light indicating dye for use as an indicator.

12 Claims, No Drawings

UV LIGHT PROTECTION FORMULA FOR FABRIC, LEATHER, VINYL AND WOOD SURFACES

BACKGROUND OF THE INVENTION

1. Field of the Invention

The instant invention relates generally to preparations and formulas which can be applied topically to a surface/substrate to reduce the amount of damage which would be subsequently caused from the exposure of such treated surfaces to ultra violet (UV) light had the surface not been treated prior to such exposure.

2. Description of the Prior Art

Numerous methods and techniques have been devised to protect various items from damage by the ultra violet spectrum of light present in sunlight an and/or ordinary ambient lighting conditions. The majority of such methods and techniques amount to providing physical protecting shields between the UV light source and the surface/substrate of the item for which protection is desired. Typically most people are familiar with the use of umbrellas, window shades, tarps, covers and a host of other such physical apparatus too numerous to mention which are commonly used to help protect various items from UV light sources.

Another method and technique devised to protect plastic fabricated items is by blending chemically active UV absorbers directly into the plastic material before it is used in a mold or some other process to form a desired article of manufacture or part.

Yet another method and technique devised to protect humans from UV light, that is from sun burns, is a whole host of sunblock lotions currently available to the general public at ordinary drug stores, and it is this topical technique which is most closely related to the instant invention disclosed in this specification.

While these examples of prior art may be suitable for the particular purpose for which they are used, they would not be suitable or as suitable for the purpose of the present invention as hereafter described.

SUMMARY OF THE INVENTION

A primary object of the present invention is to provide a plurality of UV light protection formulas which can be topically applied to various surfaces/substrates to protect such surfaces from the degrading effects of light primarily in the ultra violet range.

Another object is to provide a plurality of formulas which inhibits the photodegradation of such surfaces/-substrates which are typically indicated by all or any of the following: cracking, chalking, losing of a glossy appearance, losing of color appearance, fading, staining, oxidation and/or yellowing.

A further object is to provide UV light protection formulas which in addition to improving the appearance of particular surfaces/substrates and their UV absorption qualities, the instant formulas and processes will replace or substitute for existing products where current benefits include water and soil repellancy, as well as properties of a temporary emollient, in the case where such surfaces/substrates are vinyl or leather.

An additional object is to provide a particular UV light protection cream formula for the protection of both vinyl and leather.

A yet additional object is to provide a particular UV light protection liquid formula for the protection of both vinyl and leather.

A still further object is to provide a particular UV light protection liquid polish formula for the protection of wood, typically both finished and unfinished furniture.

Yet a still further object is to provide a particular UV light protection liquid formula for the protection of a fabric typically carpet, cloth of upholstery.

Yet a still additional object is to provide a particular UV light protection cream polish formula for the protection of wood.

A still further object is to provide a plurality of UV light protection formulas that are simple and easy to use while yet economical in cost to manufacture and affordable for consumption.

Further objects of the invention will appear as the description proceeds.

To the accomplishment of the above and related objects, this invention may be embodied in the form illustrated in the accompanying examples, attention being called to the fact, however, that the examples are illustrative only and that changes may be made in the specific proportions and chemicals illustrated and described within the scope of the appended claims.

DESCRIPTION OF BEST MODE OF THE INVENTION

In order to formulate any single specific UV protection formula of the plurality of formulas embodied by the scope of this specification it should be understood that all the formulas have in common the combining of basically three broad categories of chemical items or preblended mixture of chemical items, to create a formula which has the properties of inhibiting damaged which would be caused to a surface/substrate, by UV light impinging thereupon, had not one of the pluralities of formula been topically previously applied thereto before exposure of the UV light.

The three broad categories of chemical items which must be combine together are:

| Item: | Category of Chemical by purpose: |
|---|---|
| M | orthodox mixture of ingredients; |
| B | binder; and |
| A | light inhibitor. |

The final mixture(s) that is the instant invention (M+B+A) consists by weight of mostly the orthodox mixture of ingredients M and only relatively small amounts of the binder B and the light inhibitor A are required to achieve dramatic results. Typically the amount of the binder B is in the range of 0.01% to 3.00% of the solids by weight. If too much is used, there may be provided only little significant additional benefit and if too little is used, the desired results are degraded. Similarily the amount of the light inhibitor A is in the range of 0.01% to 3.00% of the solids by weight. If too much is used there may be provided some significant additional benefit but not without great economic cost, as well as the risk of also producing a situation which could provide toxic to humans and animals. If too little is used to desired results are degraded.

A marshalling of some typical products which can be currently purchased which would be similar in purpose to Item-M the orthodox mixture of solvent or aqueous based ingredients are as follows for:

finished wood surfaces: aerosol dusting wax sold under the trademark PLEDGE ® of S.C. Johnson & Sons Inc.; vinyl/leather surfaces: rubber and polymer preservative sold under the trademark ARMOR-ALL of Armor All Products Corp.; carpeting: an aqueous fluorochemical dispersion consisting of: N.J. trade secret registry #00850201001-5259P: 1–10%, polymethylmethacrylate: 10–20% and water 70–75% or N.J. trade secret registry #00850201001-5406P/5269-72 each 0.1–0.9%, both sold as types 5180 and 2000, respectively, under the trademarks ZONYL and TEFLON ZONYL ® and TEFLON ® of DuPont; and fabrics: a fluorochemical release treatment sold under the trademark SCOTCHGARD ® of 3M, MILEASE ® of ICI.

The binder Item-B may be either a fluorchemical, resin, silicone or acrylic, and can typically be any of the following:

fabric and textile finishing agent containing perfluoro alcohol/alkyl condensate and dipropylene glycol methyl ether; sold under the trademark MILEASE - F-89 of ICI; or fabric and textile finishing agent containing aprox. 350 ppm 1,1,1 trichloroethane sold under the trademark MILEASE - F-62 of ICI; or an aqueous fluorochemical dispersion consisting of: N.J. trade secret registry #00850201001-5259P: 1–10%, polymethylmethacrylate: 10–20% and water 70–75% or N.J. trade secret registry #00850201001-5406P/5269-72 each 0.1–0.9%, both sold as types 5180 and 2000, respectively, under the trademark ZONYL ® of Dupont; or TEFLON ® of Dupont; or a fluorochemical release treatment sold under the trademark SCOTCHGARD ® of 3M;

and increase the probability of the light inhibitor adhering to the surface/substrate; and In addition to others, the light inhibitor Item-A (also known as light absorbers, light stabilizers, and light antioxidants) may be typically either any one of the following or an emulsion mixture thereof:

2(2H-Benzotriazole-2-yl)-6-(dodecyl)-4-Methylphenol, branched and linear; bis(1,2,2,6,6-pentamethyl-4-piperidinyl) sebacate, mix; 2-(2'-hydroxy-3',5'-di-tert-amylphenyl) benzotriazole and beta-(3-(2H-benzotriazole-2-yl)-4-hydroxy-5-tert-butylphenyl) propionic acid, methyl ester and polyethylene glycol 300; sold under the trademark TINUVIN as nos. 171, 292, 328, and 1130, respectively, sold under the trademark IRGANOX as nos. B-225,1010, MD-1024,1035 and 1076, respectively, and is/are Hindered tertiary Amine Light stabilizer(s) and/or Hindered phenolic antioxidant(s), TINUVIN and IRGANOX being the trademarks of CIBA-GEIGY CORPORATION.

When preparing a batch of the instant invention that is (M+B+A) utilizing a commercially available product for the orthodox mixture of ingredients if the binder B is already present in such, that is (M+B), then in this case it is obviously only necessary to add the light inhibitor A.

EXAMPLE #1 of: UV fabric protector liquid

Prepare a typical Tinuvin Emulsion which is accomplished by mixing the ingredients as follows:

| Item | Name | Weight |
|---|---|---|
| i | BIS(1,2,2,6,6-pentamethyl-4-piperidinyl)sebacate, mix; Beta-(3-(2H-benzotriazol-2-YL)-4-hydroxy-5-tert-butylphenyl) | 25.0% |
| ii | propionic acid, methyl ester and polyethylene glycol 300 | 25.0% |
| iii | Anhydrous IPA | 50.0% |
| the result of which is: | | |
| A | — Emulsion | 100.00% |
| then combine as follows: | | |
| 1. | N.J. trade secret registry #00850201001-5259P: 1–10% polymethylmethacrylate: 10–20% and water 70–75% | 99.95% |
| A. | — Emulsion | 0.05% |

Mixing instructions for example #1:

Add Item #1 (which already contains Item B) to the result of which is:

M+B+A—UV fabric protector liquid

EXAMPLE #2 of: UV fabric protector liquid with a ultra-violet light indicating dye for use as an indicator (Subject of copending application Ser. No. 07/781,923)

Prepare a typical light inhibiting Emulsion which is accomplished by mixing the ingredients as follows:

| Item | Name | Weight |
|---|---|---|
| i | BIS(1,2,2,6,6-pentamethyl-4-piperidinyl)sebacate, mix; | 25.0% |
| ii | Beta-(3-(2H-benzotriazol-2-YL)-4-hydroxy-5-tert-butylphenyl) propionic acid, methyl ester and polyethylene glycol 300 | 25.0% |
| iii | Anhydrous IPA | 50.0% |
| the result of which is: | | |
| A | — Emulsion | 100.0% |
| then combine as follows: | | |
| 1. | DuPont Zonyl 5180 | 99.94% |
| A. | — Emulsion | 0.05% |
| 2 | fluorescent whitening agent known in the trade as Tinopal SFP | 0.01% |

Mixing instructions for example #2:

Blend #A and #2 in a vessel;

Add Item #1 (which already contains a binder B) to Emulsion (A+2) and blend with propeller until completely mixed, the result of which is:

M+B+A i.e. an UV fabric protector liquid with SIGNATURE TM of UV Science Co., an indicator.

EXAMPLE #3 of: UV Vinyl/Leather protector cream

Prepare a typical light inhibiting Emulsion which is accomplished by mixing the ingredients as follows:

| Item | Name | Weight |
|---|---|---|
| i | BIS(1,2,2,6,6-pentamethyl-4-piperidinyl) sebacate, mix | 25.0% |
| ii | Beta-(3-(2H-benzotriazol-2-YL)-4-hydroxy-5-tert-butylphenyl)propionic acid, methyl ester and polyethylene glycol 300 or 2-(2H-Benzotriazole-2-YL)-6-(dodecyl)-4-Methylphenol, branched and linear | 25.0% |

-continued

| Item | Name | Weight |
|---|---|---|
| iii | Anhydrous IPA | 50.0% |
| the result of which is: | | |
| A. | light inhibiting Emulsion | 100.0% |
| then combine as follows: | | |
| 1. | Witcamide 511 (oleic diethanol amide) | 1.0% |
| 2. | Ingredient by wt. %, stoddard solvent: 33, isopropyl alcohol: 15, dimethoxysilyl-dimethylamino-ethylaminopropyl silicone polymer: 50 and 1,2,4-trimethyl benzene: 1, sold under the trademark DOW CORNING as 531 Fluid | 2.0% |
| 3. | L-140 Solvent sold under the trademark SHELL. | 2.0% |
| 4. | Water | 23.0% |
| 5. | silicone emulsion Ingredient by wt. %, nonylphenolpolyethylene oxide: 2, quaternary ammonium compounds trimethyl tallow alkyl chloride: 2 and dimethyl, aminoethylamino-propyl siloxane copolymer: 36, sold under the trademark DOW CORNING 929 cationic emulsion | 63.9% 8.5% |
| 6. | a rheological additive sold under the trademark BENTONE 38 hereinafter referred to as a rheological additive of type C8 | 1.0% |
| 7. | Anhydrous IPA | 0.5% |
| A. | the light inhibiting emulsion obtained above | 0.05% |
| B. | fabric and textile finishing agent containing perfluoro alcohol/alkl condensate and dipropylene glycol methyl ether; sold under the trademark MILEASES - F-89 | 0.05% |

then combine as follows:

Mixing instructions for example #3:

Mix #1, #2, and #3 in a first vessel until uniform;

Add #4 mix until uniform;

Slowly add #5 mix until uniform;

Blend #A and #B in a separate vessel then slowly add to the first vessel and mix until uniform;

Add #6 by screening or sifting; and

When uniform, add #7 mix until uniform, the result of which is:

a UV Vinyl/Leather protector cream.

EXAMPLE #4 of: Vinyl/Leather protector liquid

Prepare a typical light inhibiting which is accomplished by mixing the ingredients as follows:

| Item | Trade Name | Weight |
|---|---|---|
| i | BIS(1,2,2,6,6-pentamethyl-4-piperidinyl) sebacate, mix | 25.0% |
| ii | Beta-(3-(2H-benzotriazol-2-YL)-4-hydroxy-5-tert-butylphenyl) propionic acid, methyl ester and polyethylene glycol 300, or 2-(2H-Benzotriazole-2-YL)-6-(dodecyl)-4-Methylphenol, branched and linear | 25.0% |
| iii | Anhydrous IPA | 50.0% |
| the result of which is: | | |
| A | light inhibiting emulsion | 100.0% |
| then combine as follows: | | |
| 1. | silicone emulsion Ingredient by wt. %, nonylphenolpolyethylene oxide: 2, quaternary ammonium compounds trimethyl tallow alkyl chloride: 2 and dimethyl, aminoethylamino-propyl siloxane copolymer: 36, sold under the trademark DOW CORNING 929 cationic emulsion hereinafter referred to as cationic emulsion of type B4 | 5.4% |
| 2. | silicone emulsion Ingredient by wt. % nonylphenolpolyethylene oxide: 2, sold under the trademark DOW CORNING 347 | 9.9% |
| 3. | Water | 82.1% |
| 4. | nonionic alkoxylate sold under the trade name MAKON 4 hereinafter referred to as nonionic alkoxylate of type M4 | 1.0% |
| 5. | 50% Solution of Sodium Citrate in water | 1.0% |
| 6. | Acetic Acid | 0.50% |
| A | the light inhibiting emulsion obtained above | 0.05% |
| B. | fabric and textile finishing agent containing perfluoro alcohol/alkl condensate and dipropylene glycol methyl ether; sold under the trademark MILEASE - F-89 | 0.05% |

Mixing instructions for example #4:

Mix #1 and #2 in a first vessel until uniform;

Start a low-shear mixer;

Add #3, #A, #B, and #6 and mix until uniform;

Pre-mix #4 and #5 separately;

Then add slowly to first vessel mix until uniform the result of which is:

UV Vinyl/Leather protector liquid.

EXAMPLE #5 of: UV Wood protector cream polish

Prepare a 10% Emulsion of Carnauba Wax which is accomplished by mixing the ingredients as follows:

| Item | Trade Name | Weight |
|---|---|---|
| vi | Carnauba Wax #1 Yellow | 10.0% |
| vii | polyoxyethylene (20) sorbitan monooleate, sold under the trademark TWEEN | 3.0% |
| viii | Water | 87.0% |
| the result of which is: | | |
| X. | a 10% Carnauba Wax Emulsion | 100.0% |

Prepare a 2% mixture of Carbopol which is accomplished by mixing the ingredients as follows:

| Item | Trade Name | Weight |
|---|---|---|
| iv | carboxy polymethylene or carbomer sold under the trademark CARBOPOL 934 hereinafter referred to as carboxy poly-methylene of the type C1 | 2.0% |
| v | Water | 98.0% |
| the result of which is: | | |
| Y. | a Solution of 2% in water the carboxy polymethylene of the type C1 | 100.0% |

Prepare a typical light inhibiting emulsion which is accomplished by mixing the ingredients as follows:

| Item | Trade Name | Weight |
|---|---|---|
| i | BIS(1,2,2,6,6-pentamethyl-4-piperidinyl)sebacate, mix; | 25.0% |
| ii | Beta-(3-(2H-benzotriazol-2-YL)-4-hydroxy-5-tert-butylphenyl) propionic acid, methyl ester and polyethylene glycol 300 | 25.0% |
| iii | Anhydrous IPA | 50.0% |
| the result of which is: | | |
| A | light inhibiting emulsion | 100.0% |
| then combine as follows: | | |
| 1. | silicone emulsion Ingredient by wt. %, polyethylene glycol monolauryloxy: 4, sold under the trademark DOW CORNING 346 Emulsion | 3.20% |
| 2. | silicone emulsion including, acetaldehyde, water, octamethylcyclotetrasiloxane and dimethyl siloxane, hydrox-terminated, sold under the trademark DOW CORNING | 1.00% |

-continued

| Item | Trade Name | Weight |
|---|---|---|
| | as 1101 emulsion | |
| X. | 10% Carnauba Wax Emulsion | 2.20% |
| 4. | Water | 83.28% |
| Y. | Solution of 2% carboxy polymethylene of the type C1 934 in water | 10.00% |
| 6. | Morpholine | 0.20% |
| A. | the light inhibiting emulsion obtained above | 0.05% |
| B. | fabric and textile finishing agent containing perfluoro alcohol/alkl condensate and dipropylene glycol methyl ether; sold under the trademark MILEASE - F-89 | 0.02% |
| 9. | IFF Lemon Fragrance having a trade secret formula sold by International Flavors and Fragrances of Union Beacon, NJ 07735 | .05% |

Mixing instructions for example #5:

Mix #1, #2, and #X until uniform;

Add water #4 while continuing to mix until uniform;

Add #A and #B in that order and mix until uniform;

While stirring with propeller-type mixer, and #Y, #6 and #9 in that order until uniform, the result of which is:

UV Wood protector cream polish.

EXAMPLE #6 of: UV Wood protector liquid

Prepare a typical light inhibiting emulsion which is accomplished by mixing the ingredients as follows:

| Item | Trade Name | Weight |
|---|---|---|
| i | BIS(1,2,2,6,6-pentamethyl-4-piperidinyl)sebacate, mix | 25.0% |
| ii | Beta-(3-(2H-benzotriazol-2-YL)-4-hydroxy-5-tert-butylphenyl) propionic acid, methyl ester and polyethylene glycol 300 or 2-(2'-hydroxy-3',5'-di-tert-amylphenyl)benzotriazole | 25.0% |
| iii | Anhydrous IPA | 50.0% |
| the result of which is: | | |
| A. | light inhibiting emulsion | 100.0% |
| then combine as follows: | | |
| 1. | silicone containing secret ingredients and polydimethylsiloxane sold under the trademark DOW CORNING 200 Fluid, 10,000 CST hereinafter referred to as silicone of the type D4 Fluid | 1.0% |
| 2. | silicone containing secret ingredients and polydimethylsiloxane sold under the trademark DOW CORNING 200 Fluid, 350 CST hereinafter referred to as silicone of the type D5 Fluid | 4.0% |
| 3. | sold under the trademark WITCAMIDE 511 hereinafter referred to as oleic diethanol amide of the type W8 | 1.4% |
| 4. | L-140 Solvent sold under the trademark SHELL | 14.0% |
| 5. | Lemon Fragrance having a trade secret formula sold by International Flavors and Fragrances of Union Beach, NJ 07735 | 0.5% |
| A. | the light inhibiting emulsion obtained above | 0.05% |
| B. | fabric and textile finishing agent containing aprox. 350 ppm 1,1,1 trichloroethane, sold under the trademark MILEASE - F-62 | 0.05% |
| 8. | C-340 Carbauba Wax Emulsion | 16.0% |
| 9. | Water | 63.0% |

Mixing instructions for example 190 6:

Mix #B and #4 in a vessel;

Then add #1, #2, #3, #5, #6 and #9 with good agitation until uniform;

Then add #8 with good agitation until uniform, the result of which is:

UV Wood protector Liquid.

The principle of the invention and the best mode contemplated for applying that principle have been described. It is to be understood that the foregoing is illustrative only and that other means and techniques can be employed without departing from the true scope of the invention defined in the following claims:

So there can be no ambiguity the following is presented:

APPENDIX

| | |
|---|---|
| TINUVIN (trademark) 171 | 2-(2H-Benzotriazole-2-YL)-6-(dodecyl)-4-Methylphenol, branched and linear; CAS# 125304-04-3 |
| TINUVIN (trademark) 292 SD | BIS(1,2,2,6,6-pentamethyl-4-piperidinyl) sebacate, mix; CAS# 41556-26-7 |
| TINUVIN (trademark) 328 | 2-(2'-hydroxy-3',5'-di-tert-amylphenyl) benzotriazole; CAS# 25973-55-1 |
| TINUVIN (trademark) 1130 | Beta-(3-(2H-benzotriazol-2-YL)-4-hydroxy-5-tert-butylphenyl) propionic acid, methyl ester and polyethylene glycol 300; CAS# 104810-48-2 |
| F-62 | aka Milease (trademark) F-62, fabric and textile finishing agent containing aprox. 350 ppm 1,1,1 trichloroethane; CAS# 71-55-6 |
| F-89 | aka Milease (trademark) F-89, fabric and textile finishing agent containing perfluoro alcohol/alkl condensate and dipropylene glycol methyl ether; CAS# 34590-94-8 |
| ZONYL (trademark) 5180 | aka Teflopn (trademark) 5180, aka strainmaster fabric and carpet protectant containing a fluorochemical dispersion |
| ZONYL (trademark) 2000 | aka Teflon (trademark) 2000 fabric protector containing aqueous fluorochemical disperion |

What is claimed is:

1. An ultra violet light protection cream composition for protecting a surface or substrate which is a Vinyl or Leather from damage normally caused by light in the ultra violet spectrum impinging thereon which in combination comprises:

a) a water and soil repelling emollient comprising 1.0% oleic diethanol amide Ingredient by wt. %, stoddard solvent: 33, isopropyl alcohol: 15, dimethoxysilyldimethylamino-ethylaminopropyl silicone polymer: 50 and 1,2,4-trimethyl benzene: 1, 23.0% medium aliphatic solvent naphtha, 63.9% Water, 8.5% cationic silicone emulsion Ingredient by wt. %, nonylphenolpolyethylene oxide: 2, quaternary ammonium compounds trimethyl tallow alkyl chloride: 2 and dimethyl, aminoethylaminopropyl siloxane copolymer: 36, 1.0% an organophilic clay rheological additive, 0.5% anhydrous isopropyl alcohol;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

2. An ultra violet light protection cream formula for protecting a surface or substrate which is a Vinyl or Leather from damage normally caused by light in the ultra violet spectrum impinging thereon which in combination comprises:

a) a water and soil repelling emollient comprising of 1.0% oleic diethanol amide, 2.0% Ingredient by wt. %, stoddard solvent: 33, isopropyl alcohol: 15, dimethoxysilyldimethylamino-ethylaminopropyl silicone polymer: 50 and 1,2,4-trimethyl benzene: 1, 23.0% medium aliphatic solvent naphtha, 63.9% water, 8.5% cationic silicone emulsion ingredient by wt. %, nonylphenolpolyethylene oxide: 2, quaternary ammonium compounds trimethyl tallow alkyl chloride: 2 and dimethyl, aminoethylamino-propyl siloxane copolymer: 36, 1.0% an organophilic clay rheological additive, 0.5% anhydrous isopropyl alcohol;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% 2-(2H-Benzotriazole-2-yl)-6-(dodecyl)-4-methylphenol, branched and linear and 50% anhydrous isopropyl alcohol.

3. An ultra violet light protection liquid composition for protecting a surface or substrate which is a Vinyl or Leather from damage normally caused by light in the ultra violet spectrum impinging thereon which in combination comprises:

a) a water and soil repelling emollient comprising 5.4% cationic silicone emulsion ingredient by wt. %, nonylphenolpolyethylene oxide: 2, quaternary ammonium compounds trimethyl tallow alkyl chloride: 2 and dimethyl, aminoethylamino-propyl siloxane copolymer: 36, 9.9% silicone emulsion Ingredient by wt. %, nonylphenolpolyethylene oxide: 2, 82.1% Water, 1.0% nonionic alkoxylate, 1.0% of a 50% Solution of Sodium Citrate in water, 0.50% Acetic Acid;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperdinyl) sebacate, mix, 25% Beta-(3-2H-benzotriazol-2-yl)-4-hydroxy-5-tert-butylphenyl) propionic acid, methyl ester and polyethylene glycol 300 and 50% anhydrous isopropyl alcohol.

4. An ultra violet light protection cream composition for protecting a surface or substrate which is a Wood from damage normally caused by light in the ultra violet spectrum impinging thereon which in combination comprises:

a) a water and soil repelling ingredient comprising 3.20% silicone emulsion ingredient by wt. %, polyethylene glycol monolauryloxy: 4, 1.00% silicone emulsion including, acetaldehyde, water, octamethylcyclotetrasiloxane and dimethyl siloxane, hydrox-terminated, 2.20% of a 10% Carnauba Wax #1 Yellow Emulsion with 3.0% polyoxyethylene (20) soribitan monooleate in water, 83.28% Water, 10.00% Solution of 2% carboxy polymethyene in water, 0.20% Morpholine, 0.05% IFF Lemon Fragrance;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

5. An ultra violet light protection liquid composition for protecting a surface or substrate which is a Wood from damage normally caused by light in the ultra violet spectrum impinging thereon which in combination comprises:

a) a water and soil repelling ingredient comprising 5.0% silicone containing polydimethylsiloxane, 1.4% oleic diethanol amide, 14.0% medium aliphatic solvent naphtha, 0.5% Lemon Fragrance, 16.0% Carnauba Wax Emulsion, 63.0% Water;

b) a binder which is 0.05% a fabric and textile finishing agent including 1,1,1 trichloroethane as an active ingredient; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

6. An ultra violet light protection liquid composition for protecting a surface or substrate which is a Wood from damage normally caused by light in the ultra violet spectrum impinging thereon which in combination comprises:

a) a water and soil repelling ingredient comprising 5.0% silicone containing polydimethylsiloxane, 1.4% oleic diethanol amide, 14.0% medium aliphatic solvent naphtha, 0.5% Lemon Fragrance, 16.0% Carnauba Wax Emulsion, 63.0% Water;

b) a binder which is 0.05% a fabric and textile finishing agent including 1,1,1 trichloroethane as an active ingredient; and c) a light inhibitor which is present in the proportion of 0.05% and is the emulsion mixture by weight of 25% bis(1,2,2,6,6-pentamethyl-4-piperidinyl) sebacate, mix, 25% 2-(2'-hydroxy-3',5'-di-tert-amylphenyl) benzotriazole and 50% anhydrous isopropyl alcohol.

7. A process for protecting a surface or substrate which is a Vinyl or Leather from damage normally caused by light in the ultra violet spectrum impinging thereon which comprises coating the surface with a composition which includes:

a) a water and soil repelling emollient comprising 1.0% oleic diethanol amide, 2.0% Ingredient by wt. %, stoddard solvent: 33, isopropyl alcohol: 15, dimethoxysilyldimethylamino-ethylaminopropyl silicone polymer: 50 and 1,2,4-trimethyl benzene: 1, 23.0% medium aliphatic solvent naphtha, 63.9% Water, 8.5% cationic silicone emulsion Ingredient by wt. %, nonylphenolpolyethylene oxide: 2, quaternary ammonium compounds trimethyl tallow alkyl chloride: 2 and dimethyl, aminoethylaminopropyl siloxane copolymer: 36, 1.0% an organophilic clay rheological additive, 0.5% anhydrous isopropyl alcohol;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

8. A process for protecting a surface or substrate which is a Vinyl or Leather from damage normally caused by light in the ultra violet spectrum impinging thereon which comprises coating the surface with a composition which includes:

a) a water and soil repelling emollient comprising 1.0% oleic diethanol amide, 2.0% Ingredient by wt. %, stoddard solvent: 33, isopropyl alcohol: 15, dimethoxysilyldimethylamino-ethylaminopropyl silicone polymer: 50 and 1,2,4-trimethyl benzene: 1, 23.0% medium aliphatic solvent naphtha, 63.9% Water, 8.5% cationic silicone emulsion Ingredient by wt. %, nonylphenolpolyethylene oxide: 2, quaternary ammonium compounds trimethyl tallow alkyl chloride: 2 and dimethyl, aminoethylamino-propyl siloxane copolymer: 36, 1.0% an organophilic clay rheological additive, 0.5% anhydrous isopropyl alcohol;

b) a binder which is 0.05% a fabric and textile finishing agent of a type including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% 2-(2H-Benzotriazole-2-yl)-6-(dodecyl)-4-methylphenol, branched and linear and 50% anhydrous isopropyl alcohol.

9. A process for protecting a surface or substrate which is a Vinyl or Leather from damage normally caused by light in the ultra violet spectrum impinging thereon which comprises coating the surface with a composition which includes:

a) a water and soil repelling emollient comprising 5.4% cationic silicone emulsion Ingredient by wt. %, nonylphenolpolyethylene oxide: 2, quaternary ammonium compounds trimethyl tallow alkyl chloride: 2 and dimethyl, aminoethylamino-propyl siloxane copolymer: 36, 9.9% silicone emulsion Ingredient by wt. %, nonylphenolpolyethylene oxide: 2, 82.1% Water, 1.0% nonionic alkoxylate, 1.0% of a 50% Solution of Sodium Citrate in water, 0.50% Acetic Acid;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

10. A process for protecting a surface or substrate which is a Wood from damage normally caused by light in the ultra violet spectrum impinging thereon which comprises coating the surface with a composition which includes:

a) a water and soil repelling ingredient comprising 3.20% silicone emulsion Ingredient by wt. %, polyethylene glycol monolauryloxy: 4, 1.00% silicone emulsion including, acetaldehyde, water, octamethylcyclotetrasiloxane and dimethyl siloxane, hydroxy-terminated, 2.20% of a 10% Carnauba Wax #1 Yellow Emulsion with 3.0% polyoxyethylene (20) soribitan monooleate in water, 83.28% Water, 10.00% Solution of 2% carboxy polymethylene in water, 0.20% morpholine 0.05% Lemon Fragrance;

b) a binder which is 0.05% a fabric and textile finishing agent including perfluoro alcohol/alkyl condensate and dipropylene glycol methyl ether; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

11. A process for protecting a surface or substrate which is a Wood from damage normally caused by light in the ultra violet spectrum impinging thereon which comprises coating the surface with a composition which includes:

a) a water and soil repelling ingredient comprising 5.0% silicone containing polydimethylsiloxane, 1.4% oleic diethanol amide, 14.0% medium aliphatic solvent naphtha, 0.5% Lemon Fragrance, 16.0% Carnauba Wax Emulsion, 63.0% Water;

b) a binder which is 0.05% a fabric and textile finishing agent including 1,1,1 trichloroethane as an active ingredient; and c) a light inhibitor which is present in the proportion of 0.05% and is the emulsion mixture by weight of 25% bis(1,2,2,6,6-pentamethyl-4-piperidinyl) sebacate, mix, 25% Beta-(3-(2H-benzotriazol-2-yl)-4-hydroxy-5-tert-butylphenyl) propionic acid, methyl ester and polyethylene glycol 300 and 50% anhydrous isopropyl alcohol.

12. A process for protecting a surface or substrate which is a Wood from damage normally caused by light in the ultra violet spectrum impinging thereon which comprises coating the surface with a composition which includes:

a) a water and soil repelling ingredient comprising 5.0% silicone containing polydimethylsiloxane, 1.4% oleic diethanol amide, 14.0% medium aliphatic solvent naphtha, 0.5% Lemon Fragrance, 16.0% Carnauba Wax Emulsion, 63.0% Water;

b) a binder which is 0.05% a fabric and textile finishing agent including 1,1,1 trichloroethane as an active ingredient; and c) a light inhibitor which is present in the proportion of 0.05% and is the emulsion mixture by weight of 25% bis(1,2,2,6,6-pentamethyl-4-piperidinyl) sebacate, mix, 25% 2-(2'-hydroxy-3',5'-di-tert-amylphenyl) benzotriazole and 50% anhydrous isopropyl alcohol.

* * * * *